US008567211B2

(12) United States Patent
Al-Rasheed

(10) Patent No.: US 8,567,211 B2
(45) Date of Patent: Oct. 29, 2013

(54) PORTABLE HYGENIC ICE CHEST FOR MEDICAL SUPPLIES OR THE LIKE

(76) Inventor: Hafeth A. Al-Rasheed, Bayan (KW)

( * ) Notice: Subject to any disclaimer, the term of this patent is extended or adjusted under 35 U.S.C. 154(b) by 891 days.

(21) Appl. No.: 12/706,875

(22) Filed: Feb. 17, 2010

(65) Prior Publication Data

US 2011/0197624 A1 Aug. 18, 2011

(51) Int. Cl.
*F25D 3/12* (2006.01)

(52) U.S. Cl.
USPC ..... 62/388; 62/371; 62/457.5; 62/457.7; 62/331

(58) Field of Classification Search
USPC ..... 62/388, 371, 457.5, 457.7, 459, 331, 62
See application file for complete search history.

(56) References Cited

U.S. PATENT DOCUMENTS

| | | | | |
|---|---|---|---|---|
| 2,046,451 | A * | 7/1936 | Grayson | 62/168 |
| 2,187,387 | A * | 1/1940 | Trigg et al. | 62/466 |
| 2,215,372 | A * | 9/1940 | Howeth | 62/382 |
| 2,756,570 | A * | 7/1956 | Gale | 62/331 |
| 3,762,592 | A * | 10/1973 | Mayes | 220/4.21 |
| 3,971,231 | A * | 7/1976 | Derry | 62/388 |
| 3,992,069 | A * | 11/1976 | Kitterman | 312/244 |
| 4,050,264 | A * | 9/1977 | Tanaka | 62/457.2 |
| 4,288,996 | A | 9/1981 | Roncaglione | |
| 4,471,629 | A * | 9/1984 | Toledo-Pereyra | 435/1.3 |
| 5,709,104 | A | 1/1998 | Howcroft | |
| 6,408,634 | B1 * | 6/2002 | Choi | 62/127 |
| 6,502,405 | B1 * | 1/2003 | Van Winkle | 62/3.61 |
| 6,751,963 | B2 | 6/2004 | Navedo et al. | |
| 6,799,434 | B1 * | 10/2004 | Hobbs, Jr. | 62/457.9 |
| 7,024,876 | B1 * | 4/2006 | Kishek | 62/236 |
| 7,481,070 | B2 | 1/2009 | Costanzo | |
| 2003/0217564 | A1 * | 11/2003 | Jones et al. | 62/390 |
| 2005/0166601 | A1 * | 8/2005 | Culp et al. | 62/6 |
| 2005/0188715 | A1 * | 9/2005 | Aragon | 62/371 |
| 2009/0106942 | A1 * | 4/2009 | Dell'Orfano | 16/425 |
| 2009/0277187 | A1 * | 11/2009 | McGann | 62/3.6 |

OTHER PUBLICATIONS

Gujarat Cork & Rubber PVT. Ltd., Rubberized Cork Sheet, Apr. 2009, obtained from http://www.gujaratcork.com/2.htm on Apr. 18, 2013.*

* cited by examiner

*Primary Examiner* — Cheryl J Tyler
*Assistant Examiner* — Orlando E Aviles Bosques
(74) *Attorney, Agent, or Firm* — Lowe Hauptman Ham & Berner, LLP

(57) ABSTRACT

A generally box shaped portable ice chest for medical supplies and the like includes a plastic housing having a top, bottom, front, back and two sides and an inner compartment within the plastic housing. Between the plastic housing and inner compartment there are three layers of insulation including a Styrofoam polystyrene foam layer, a compressed cork layer and a compressed rubber layer sandwiched between the stainless steel lining and the outer housing. The inner compartment includes three removable vertically stacked drawers and a beverage compartment behind the drawers for receiving a plurality of beverage containers. One of the drawers is adapted to receive dry ice. Each of the drawers includes a plurality of openings. A fan, a solar panel and a rechargeable battery and circuit for charging the battery are disposed in the top of the housing for circulating air through the drawers and beverage container.

1 Claim, 2 Drawing Sheets

PORTABLE HYGENIC ICE CHEST FOR MEDICAL SUPPLIES OR THE LIKE

FIELD OF THE INVENTION

This invention relates to a portable ice chest for medical supplies and/or the like and more particularly to a portable ice chest with a compartment for dry ice, a solar panel, rechargeable battery and a circuit for charging the battery.

BACKGROUND FOR THE INVENTION

Medical facilities such as hospitals and medical laboratories have a need to transport and preserve samples, vaccines, medicines and even human organs under cool or cold conditions and frequently under sterile conditions. Further, it is frequently necessary to transport such materials in a vehicle without having access to an electrical outlet.

In the past there have been many well know portable sublimation refrigerator-freezers that have been used for storing and/or transporting medical supplies and food items. For example, a Roncaglione U.S. Pat. No. 4,288,996 discloses a sublimation refrigerator having a thermally insulated outer housing with a pivotal top. A small insulated dry ice chamber is adapted to be supported centrally within the container as is a separate insulated freezer compartment having a removable top. A first set of serpentine cooling coils are supported in the interior side walls of the main insulated container and in the side walls of the freezer compartment. One end of each of these coils connects to the dry ice chamber. A bubble type visual flow indicator having a transparent window is supported on the exterior of the main container. The output ends of both the freezer coil and the cooler coil connect to the visual indicator through manually adjustable flow control valves. The output of the visual indicator vents to the atmosphere. In normal use, the valve at the output of the freezer coil is opened allowing the flow of gas sublimating from the dry ice through the freezer coil so that a very low temperature is attained within the freezer. The valve at the output of the cooler coil is then used to control the flow to attain a desired cooler temperature and the freezer valve may be temporarily closed allowing the visual indicator to be used for adjustment of the cooler coil. Since both freezer and cooler coils are fed simultaneously control of each area is by the valves, and closing either one will allow all gases to go through a desired area.

A more recent Howcroft U.S. Pat. No. 5,709,104 for a cooling device for an insulated ice chest discloses a portable cooling apparatus. The apparatus includes a thermally insulated housing, such as a conventional hand carried ice chest with a lid for removably covering the main opening. A thermally insulated dry ice chamber is disposed inside the chest. The dry ice chamber is vented and a fan is contained within the chamber. Dry ice is placed in the chamber and sublimates into cold gas which expands and passes from the vented chamber into the chest to cool the chest. Cooling action is increased by selectively actuating the fan to drive the sublimated gas rapidly into the chest, thereby causing air movement within the chest in a circulating flow pattern passing through the ice chamber.

Finally, a Costanzo U.S. Pat. No. 7,481,070 discloses a solar powered chilled cooler. As disclosed therein the cooler includes a plurality of coolant lines embedded in a plurality of walls of the cooler unit. The coolant lines include coolant fluid; a compressor coupled to the coolant lines; a fan adapted to circulate air around the coolant lines; a thermostat adapted to measure the cooler unit internal temperature; a temperature adjust control coupled to the compressor and to the thermostat; the temperature adjust control adapted to cause the cooler unit internal temperature to be adjusted; an AC power supply adapted to receive AC power when available; a DC power jack adapted to receive DC power when available; a rechargeable battery coupled to the AC power supply and to the DC power jack, the rechargeable battery adapted to operate the compressor and the fan when the cooler unit is ON, and the cooler unit is not receiving external power; and a foldable solar panel at least including a photovoltaic array, the solar panel adapted to be functionally stored when folded into the top of the cooler unit, and conduct electricity when exposed to sunlight, and the solar panel adapted to connect via a power cord to the DC power jack and power the cooler unit.

Notwithstanding the above, it is presently believed that there is a need and a potential commercial market for an improved portable ice chest for medical supplies, food supplies and beverages in accordance with the present invention. There should be a demand for the improved ice chest because they are durable, reliable and relatively inexpensive and at the same time can store materials for relatively long periods of time without access to a source of electricity. Further, the devices are relatively easy to clean and treat with sanitizers to thereby provide a relatively sterile environment.

BRIEF SUMMARY OF THE INVENTION

In essence the present invention contemplates a portable ice chest for medical supplies, food supplies and beverages in which the ice chest comprises or consists of a plastic housing having a top, bottom, front, back and two sides. The housing also defines an inner compartment within the housing and three layers of insulation between the inner compartment and the plastic housing and a lining of stainless steel surrounding the inner compartment on an inner side thereof.

In addition, the inner compartment includes three removable vertically stacked drawers and a beverage compartment behind the drawers for receiving a plurality of beverage containers and wherein one of the drawers is disposed between the other two drawers and is adapted to receive a mass of dry ice therein and each of the drawers includes a plurality of openings therein.

A fan, a solar panel, a rechargeable battery and circuit means for charging the battery are disposed in the top of the housing for circulating air through the drawers and said beverage compartment. In addition, the system or device includes three layers of insulation including an inner insulation of polystyrene foam, a compressed rubber and compressed cork and wherein the stainless steel lining includes drawer guides on the sidewalls of the chamber. Two of the drawers are positioned in the chamber by sliding onto the drawer guides while the third rest on the stainless steel lining on the bottom of the chamber.

The invention will now be described in connection with the accompanying drawings wherein like reference numerals have been used to indicate like parts.

DESCRIPTION OF THE PREFERRED EMBODIMENTS OF THE INVENTION

Hospitals and laboratories associated with medical practitioners take customary steps to preserve blood samples, medicines, vaccines and human organs under relatively cold temperatures and in a hygienic environment away from contamination. Also, in view of specializations, it is frequently necessary to transport blood samples, medicines, vaccines and even human organs from one department to another and at times from one hospital to another. Therefore, the portable hygienic ice chest fills such needs because of its practical features that allow the transfer of such items while maintaining them at a relatively cold temperature in a clean environment. The use of dry ice maintains a cold temperature while solar energy and/or a rechargeable battery power a fan for circulating air through the device. After the cold air is circulated it is exhausted through adjustable vents located in the top of the ice chest.

Figure 1:
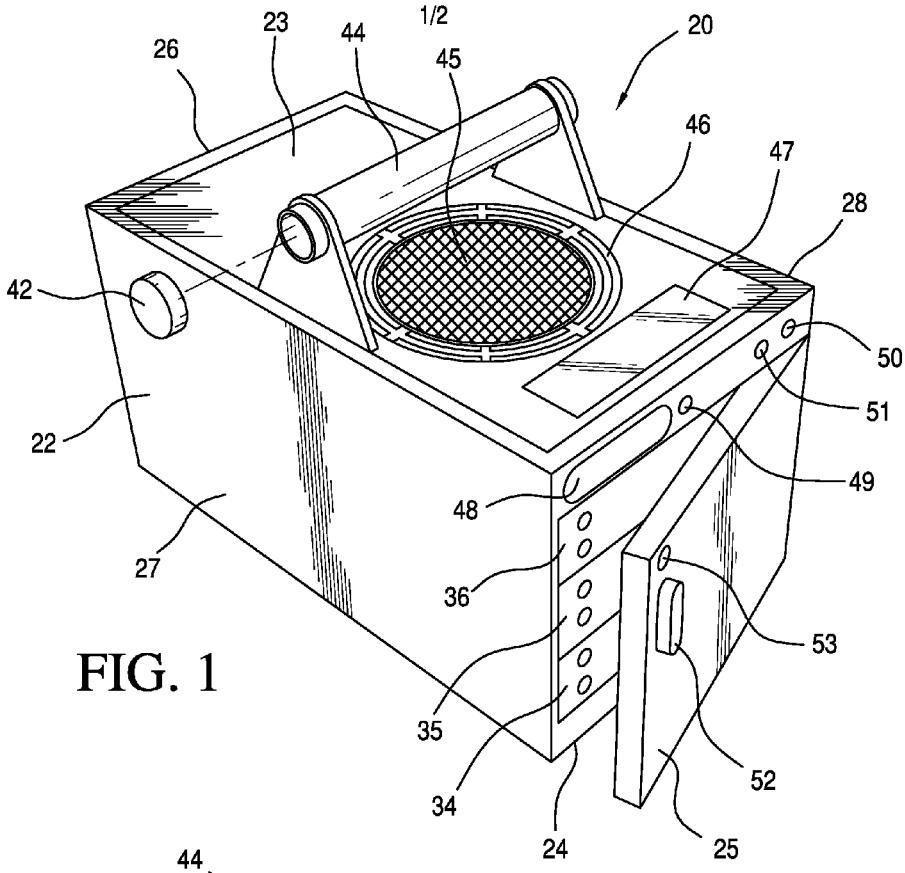
FIG. 1 is a perspective view of a portable ice chest in accordance with the present invention.
Figure 2:
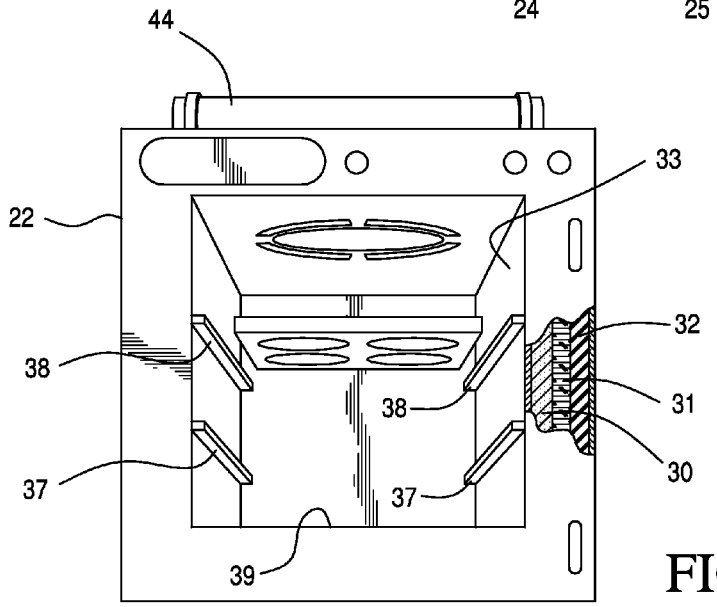
FIG. 2 is a perspective view of the portable ice chest shown in FIG. 1 with drawers removed to illustrate the interior and layers of insulation in accordance with the present invention.
Figure 3:
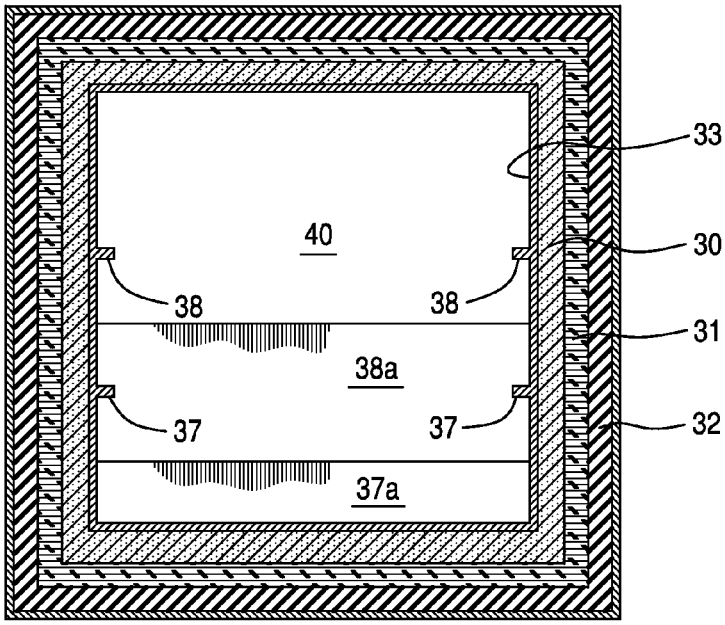
FIG. 3 is a top or plan view of the chamber shown in FIGS. 1 and 2.
Figure 4:
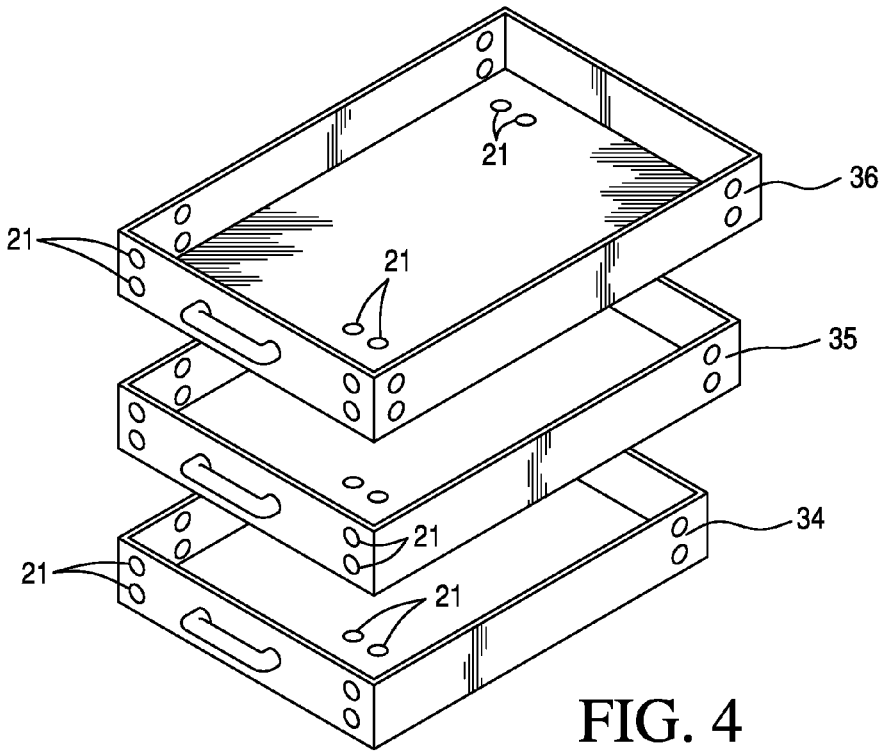
FIG. 4 is a schematic illustration of the drawers as used in the present invention for storing dry ice as well as medical and/or food supplies.

As shown in FIGS. 1-3 a portable hygienic ice chest 20 for medical supplies, food and beverages includes an outer plastic housing 22 having a top 23, bottom 24, front or door 25, back 26 and two sides 27 and 28. The chest 20 also defines an inner compartment 39 within the plastic housing 22 and separated therefrom by three insulating layers 30, 31, and 32 (see FIGS. 2 and 3) and a stainless steel lining 33 that surrounds the inner chamber 39 and provides a surface that is easily cleaned and easily sterilized with an appropriate sanitizer.

The three insulating layers 30, 31, and 32 are made of a Styrofoam sheet as layer 30, compressed cork as layer 31 and compressed rubber as layer 32. These layers abut one another and are incased by the plastic housing 22 and stainless steel lining 33. The layers 30, 31, and 32 surround the inner compartment and cover the internal portion of the door 25.

The chest 20 also includes three vertically stacked drawers 34, 35, and 36 (FIG. 1) that ride on drawer guides 37 and 38 while the bottom drawer 34 slides on the stainless steel lined bottom of the inner compartment 39. Each of the drawers 34, 35 and 36 include a plurality of small openings 21 to allow cool air to circulate there through. The top and bottom drawers 34 and 36 contain medical and/or food supplies while the middle drawer 35 contains a mass of dry ice.

As shown in FIG. 1, the top 23 of the chest 20 includes an electric fan 45, a plurality of vents 46 and a solar panel 47. A circuit is provided to charge a battery 48 that powers the fan 45 to circulate cold air from the dry ice into the drawers 34 and 36 and into the beverage compartment 40 behind the drawers 34, 35, and 36 at wall portions 37*a* and 38*a*. The drawers are readily removable from the compartment 39 through the open door 25 for cleaning. In addition, the top 23 of the ice chest 20 also includes a hollow or tubular handle 44 for carrying the chest 20. This hollow handle 44 includes a cap 42 for closing the hollow handle 44 that is adapted for carrying an inventory of items in the chest 20 as well as the time of filling with dry ice and recommendation for adding additional dry ice. As shown in FIG. 1, an area above the door 25 includes a rechargeable battery 48 and includes an indicator 49 that indicates the charge on the battery. Further, temperature indicators 50 and 51 indicate the temperatures in the drawers 34 and 36 respectively. Further, the door 25 also includes a handle 52 and lock assembly 53.

While the invention has been described in connection with its preferred embodiment it should be recognized that changes and modifications may be made therein without departing from the scope of the appended claims.

What is claimed is:

1. A portable ice chest for medical supplies, food supplies and beverages, said portable ice chest consisting of:

a plastic housing having a top wall, a bottom wall, an open front, a back wall and two side walls, and an inner compartment within said plastic housing and three layers of insulation between said inner compartment and said plastic housing and a lining of stainless steel surrounding said inner compartment on an inner side thereof and wherein;

said inner compartment includes three removable vertically stacked drawers and a beverage compartment behind said drawers for receiving a plurality of beverage containers and wherein one of said drawers is disposed between the other two of said drawers and is adapted to receive a mass of dry ice therein and each of said drawers including a plurality of openings therein for allowing air to circulate there through;

a fan, a plurality of vents, a solar panel, a rechargeable battery and a circuit for charging said battery from said solar panel in said top wall of said housing for circulating air through said drawers and said beverage compartment;

wherein said three layers of insulation include an inner insulation of polystyrene foam, a compressed rubber and a compressed cork and wherein the stainless lining includes drawer guides on both sides of said inner compartment;

a door for closing said open front;

an area above said door including an indicator to show the charge on the battery and two temperature indicators to indicate the temperatures in said top and bottom drawer; and a hollow tubular handle attached to said top of said housing and adapted to receive an inventory of items in said ice chest, time and date of packing with items and any special handling required for medical supplies contained therein and a cap for closing said handle.

* * * * *